United States Patent [19]

Rozanc

[11] Patent Number: 4,940,365

[45] Date of Patent: Jul. 10, 1990

[54] MINE ROOF SUPPORT PLATE BOLT

[75] Inventor: Richard A. Rozanc, Muse, Pa.

[73] Assignee: Ground Control, Inc., Cecil, Pa.

[21] Appl. No.: 353,904

[22] Filed: May 18, 1989

[51] Int. Cl.[5] ..... E21D 20/02

[52] U.S. Cl. ..... 405/261; 405/260

[58] Field of Search ..... 405/260, 261, 259; 411/15, 44, 57, 60; 52/704

[56] References Cited

U.S. PATENT DOCUMENTS

| | | | |
|---|---|---|---|
| 3,188,815 | 6/1965 | Schuermann et al. | 405/261 |
| 4,132,080 | 1/1979 | Hansen | 405/261 |
| 4,275,975 | 6/1981 | Morgan | 405/261 |
| 4,313,697 | 2/1982 | Rozanc | 405/261 |

*Primary Examiner*—Dennis L. Taylor

*Attorney, Agent, or Firm*—Parmelee, Miller, Welsh & Kratz

[57] ABSTRACT

A mine roof support plate bolt formed from an elongated rod has a head and flange at one end, and a helical channel adjacent the other end, the rod having a threaded section adjacent the channeled section and an expansion anchor engaged on the threaded section. The channeled section of the rod has a length greater than the length of the expansion anchor such that a major portion of the channeled section is exposed regardless of the positioning of the expansion anchor on the threaded section.

14 Claims, 3 Drawing Sheets

MINE ROOF SUPPORT PLATE BOLT

BACKGROUND OF THE INVENTION

The use of support plates to reinforce or stabilize mine roofs, in order to prevent roof falls is well known and generally use support plates that are held flush to the mine roof by bolts secured in bore holes formed in the rock strata of the roof.

Some bolts are anchored in the bore holes by the use of a mechanical means such as anchors that expand and are secured to the wall of the bore hole, while others are secured in the bore holes by a quick setting resin. Other bolts have been secured by the use of a combination of mechanical and resin means.

Examples of a combined mechanical-resin anchoring system for mine roof bolts are illustrated in U.S. Pat. No. 4,162,133 and U.S. Pat. No. 4,299,519, where an expansion anchor is provided and the combination rotated together in one direction in a bore hole to break a resin package and the rotation then reversed to anchor the bolt by expansion of an expandable anchor.

In U.S. Pat. No. 4,313,697, which issued to my father, Richard C. Rozanc, and which is incorporated by reference herein, a mine roof support plate bolt is described which is formed from a concrete reinforcing rod, or rebar, and has a helical channel at one end thereof. The helical channel is formed in the rebar in a direction opposite the rotation of the bolt during fixation of the bolt in a bore hole and a resin package inserted into the bore hole preceding the bolt is shredded by teeth in the end of the bolt, with the resin released from the resin package pumped towards the end of the bore hole so as to retain the resin at the end portion of the bolt in the bore hole and provide a more secure anchoring thereof.

Because the placement of mine roof bolts in bore holes is a labor intensive procedure, however, development has been desired of a bolt that is readily and quickly secured in a bore hole in a mine roof which will enable time savings while retaining the safety of a securely anchored bolt and mine roof support plate. While the mine roof support plate bolt described in U.S. Pat. No. 4,313,697 is suited for secure anchoring of the bolt in a bore hole, even quicker securement of the bolt would be beneficial in order to speed up the securement of support plate to a mine roof and stabilizing thereof, while maintaining secure engagement of the bolt in a bore hole.

SUMMARY OF THE INVENTION

A mine roof support plate bolt formed from a metallic elongated rod, having a head and flange at one end thereof, and preferably a transverse groove in the other end forming cutting teeth, with a helical channel in the rod adjacent the other end, has a threaded section on the rod adjacent the channeled section and an expansion anchor comprising a wedge and hollow shell threadedly engaged thereon. The channeled section of the rod must have a length greater than the length of the anchor so that a major portion of the channeled section is exposed regardless of the positioning of the expansion anchor on the threaded section. This construction ensures that a substantial portion of the channeled section is available to mix and set up in a quick setting resin, while the expansion anchor provides an initial securement of the bolt in a bore hole formed in rock strata.

DESCRIPTION OF THE DRAWINGS

The invention will become more readily apparent from the following description of preferred embodiments thereof shown, by way of example only, in the accompanying drawings, wherein.

DETAILED DESCRIPTION

Figure 1:
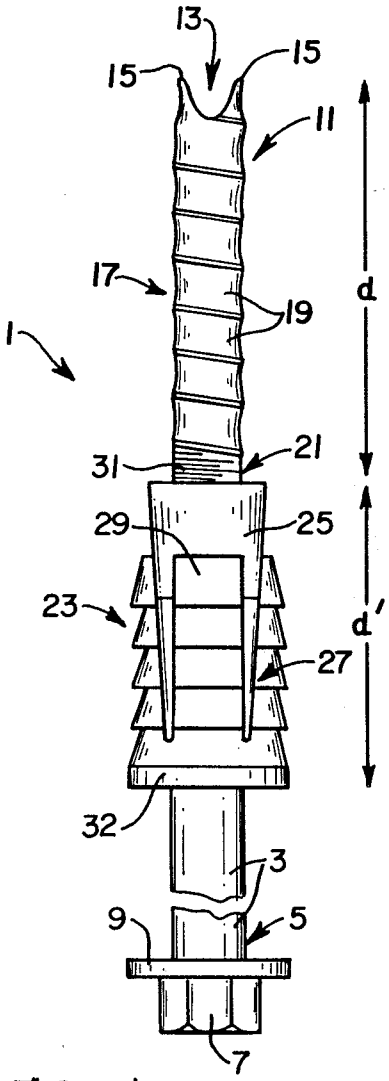
FIG. 1 is an elevational view of the mine roof support plate bolt of the present invention.

Referring now to the drawings, FIG. 1 illustrates the preferred mine roof support plate bolt 1 of the present invention. The bolt 1 is formed from a metallic elongated rod 3 and has at one end 5 thereof a head 7 and flange or washer 9. At the other end 11 of the rod 3 there is provided a transverse groove 13 which is cut into the end and forms cutting teeth 15. Adjacent the other end 11 there is also provided a channeled section 17 having a helical channel 19.

Adjacent the channeled section 17, on the side thereof opposite the groove 13, a threaded section 21 is provided for the threaded engagement therewith of an expansion anchor 23. The expansion anchor 23 is of conventional design and may be of various forms which include a tapered wedge 25 that has an internal threaded bore, and a hollow shell 27 that has at least two, and preferably more, radially expandable portions 29. At least a portion of the wedge 25 is always within the shell 27 when engaged on the rod 3. Threads on the internal wall of the hollow shell 27 are also provided, such that the threads on the wedge bore and the shell internal wall mate with the threads 31 of the threaded section 21 of the elongated rod 3. A pal nut 32 is provided adjacent the lower end of the expansion anchor 23. While the unchanneled and unthreaded section of the elongated rod is illustrated as smooth, a rough texture or rebar-type rod may also be used.

Figure 5:
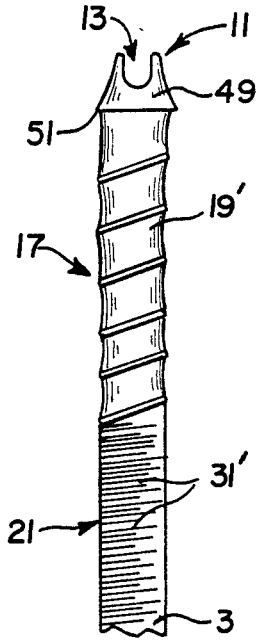
FIG. 5 is an elevational view of the threaded and channeled sections of an alternate embodiment of the present invention.
Figure 6:
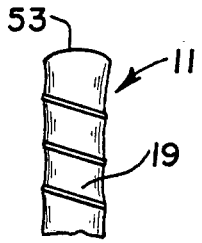
FIG. 6 is a view of an alternative cutting section of a mine roof support plate bolt of the present invention.

The threads 31 on the elongated rod 3 may be standard, right-handed threads, such that the elongated rod 3 is advanced through the wedge 25 by clockwise rotation, in which case the helical channel 19 is a counterclockwise channel, as illustrated in FIGS. 1 to 4, so as to force resin upwardly as hereinafter described. Or, the threads 31 on the elongated rod 3 may be left-handed threads, such that the elongated rod is advanced through the wedge 25 by counterclockwise rotation, in which case the helical channel 19 is a clockwise channel so as to force resin upwardly, as illustrated in FIGS. 5 and 6.

Figure 2:
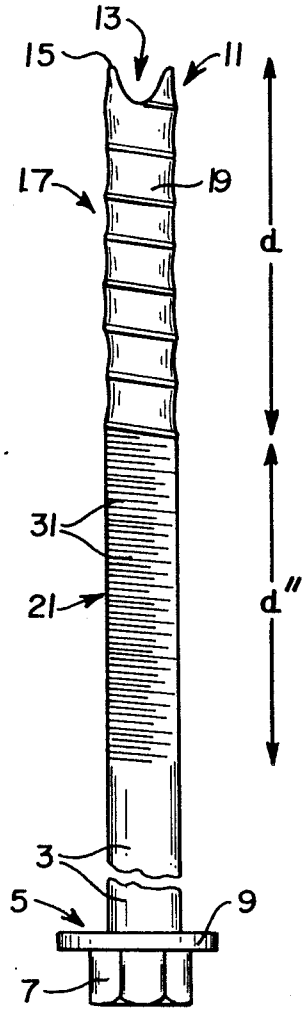
FIG. 2 is an elevational view of the metallic elongated rod of the mine roof support plate bolt illustrated in FIG. 1.

It is critical to the present invention that the channeled section 17 on the elongated rod 3 have a length d which is longer than the length d' of the expansion anchor 23 such that a major portion of the channeled section 17 length is exposed regardless of the positioning of the expansion anchor 23 on the threaded section 21 of the elongated rod 3. The threaded section 21 of the elongated rod 3 has a length d" which is also longer than the length d of the channeled section 17 of the elongated rod 3, as illustrated in FIG. 2. Also, the threads 31 on the threaded section 21 are of a size that the diameter across the ridges of the threads is greater than the unthreaded and unchanneled portion of the elongated rod 3.

Figure 3:
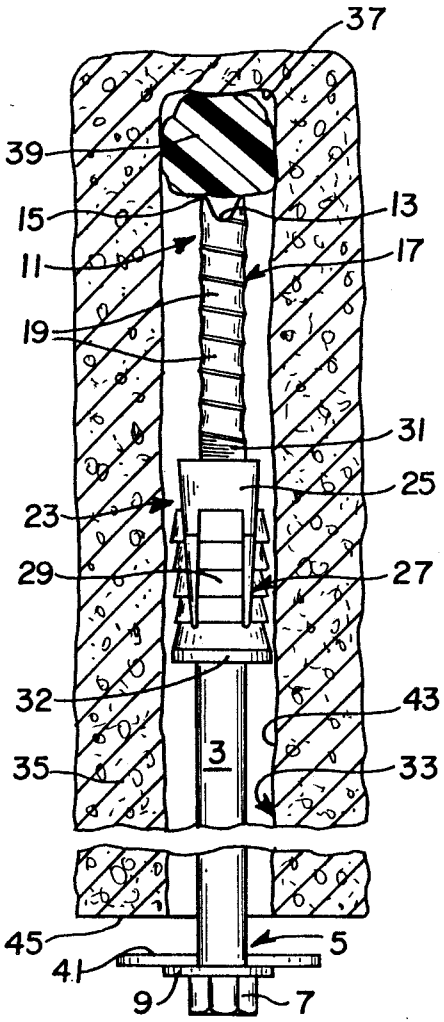
FIG. 3 is a view of the mine roof support plate bolt of FIG. 1 illustrating the same upon insertion into a bore hole in a mine roof.
Figure 4:
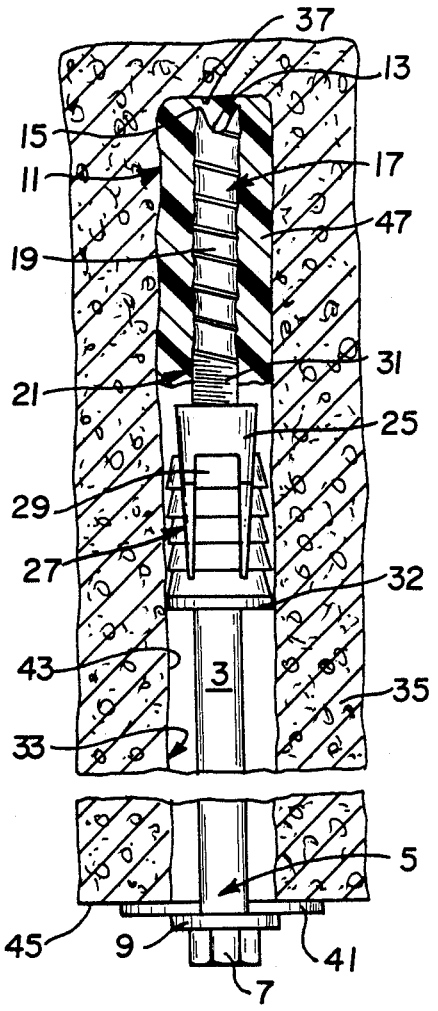
FIG. 4 is a view as in FIG. 3 upon fixation of the mine roof support plate bolt in the bore hole by resin.

The procedural steps for using the mine roof support plate bolt 1 in reinforcement of a rock strata such as in a mine roof is illustrated in FIGS. 3 and 4 where a right hand threaded section 21 and counterclockwise channeled section 17 are provided on the bolt. A bore hole 33 is first drilled into the rock strata 35, which bore hole 33 has a closed end 37. A resin package 39 containing a conventional quick setting resin is inserted into the bore hole 33 and moved to a position adjacent the closed end 37 by use of the mine roof support plate bolt 1, with a support plate 41 positioned on the bolt, and resting on flange 9, adjacent the one end 5 of the bolt outside the bore hole 33. The expansion anchor 23, which has been previously threadedly connected to the threaded section 21 of the elongated rod 3 is of a size that the radially expandable portions 29 thereof contact the wall 43 of the bore hole 33 and is frictionally secured so as to prevent rotation thereof in the bore hole 33, as illustrated in FIG. 3. The other end 11 of the mine roof support plate bolt 1 is spaced from the closed end 37 of the bore hole 33 with the resin package 39 disposed between the closed end 37 and the cutting teeth 15 of the elongated rod 3.

To secure the mine roof support plate bolt in the bore hole 33 and pull the support plate into contact with the surface 45 of the rock strata 35, the elongated rod 3 is rotated clockwise which advances the same through the expansion anchor 23, expanding the radially expandable portions 29 of the shell 27 by forcing the plug into the shell, and providing an initial securement of the mine roof support plate bolt 1. Continued clockwise rotation of the elongated rod 3 causes the rod to pass through the expansion anchor 23, while at the same time shredding the resin package 39 and mixing the resin while pumping the resin towards the closed end 37 of the bore hole 33 is effected by the counterclockwise channel 19. The mixed resin 47 (FIG. 4) then sets up while the support plate 41 is flush with the surface 45 of the rock strata 35.

In the embodiment illustrated in FIG. 5, the elongated rod 3 has a channeled section 17 wherein a helical channel 19' is a clockwise channel and the threads 31' on threaded section 21 are left-handed threads. Also, as shown in FIG. 5, the other end 11 of the rod has an enlarged cutting head 49 thereon in which is formed the transverse groove 13. As illustrated, the enlarged cutting head 49 may be in the form of a truncated cone with the apex 51 of the cone having the transverse groove 13 formed therein and the base 53 of the cone having a diameter greater than the diameter of the channeled section 17. The enlarged cutting head 49 may be formed integrally with the elongated rod 3, or the same may be welded or otherwise secured to the end of a channeled section 17 of the rod 3.

Figure 7:
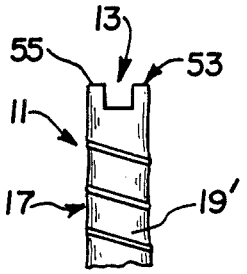
FIG. 7 is a view of a cutting section showing a groove through the embodiment shown in FIG. 6.

The embodiment illustrated in FIG. 6 shows the end 11 in the form of a substantially flat end 53, or in a slight convex shape. In FIG. 7, a flat end 53 is provided with a transverse groove 13 formed in the flat end 53 to leave extensions 55 on each side of the transverse groove 13 serving as cutting elements in lieu of sharp cutting teeth.

Figure 8:
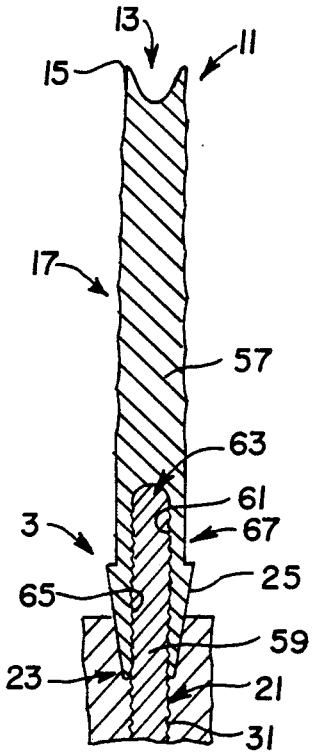
FIG. 8 is a cross-sectional view of another embodiment of the present invention with the elongated rod formed from segments.

The embodiment illustrated in FIG. 8 shows the elongated rod 3 formed from segments 57 and 59, that are engageable to form the rod. The first segment 57 has the channeled section 17 thereon, while the second segment 59 has the threaded section thereon. The first and second segments 57 and 59 are engageable such as through the use of threads 61 on the end 63 of second segment 59 which engage in a threaded bore 65 in the end 67 of first segment 57. In assembly of the embodiment of FIG. 8, the expansion anchor would be threaded onto the threaded section 17 of the second rod segment 59 and the first segment 57 then threadedly engaged with the second segment 59, the threads 61 would be in the same direction, right- or left-handed, as the threads 31 on threaded section 21 of the second segment 59.

As an example of the dimensions of a preferred mine roof support plate bolt, illustrated in FIGS. 1 and 2, of the present invention, for use in a bore hole having a diameter of one inch, the rod 3 would be of a diameter of about 9/16 inch, with a head 7 of a diameter of about 1 1/16 inch and flange 9 of about 1¾ inch. The length of the rod 3 may vary between about 2 to 12 feet depending upon the depth of the bore hole. For a typical 4-foot rod, a channeled section 17 of about 2¾ inch would be used, and an expansion anchor 23 of a length of about 2¾ inch (2¼ inch long hollow shell 27 and a wedge of about 1⅛ inch), or less, threadedly engaged on a threaded section 21, having a length of about 3¾ inch, on the rod 3, using ⅝×11 threads, i.e. 11 threads per inch. The channeled section 17 is preferably of a size providing 2 channels 19 per inch of channeled section, the channels having a depth of about ⅛ inch.

The mine roof support plate bolt of the present invention allows fast securement of the bolt in a bore hole. For example, using the bolt described in U.S. Pat. No. 4,313,697 a time period of about thirty seconds is required before the resin sets to an extent that the operator can move to a subsequent bore hole, while with the use of the present described bolt, the initial securement of the anchor enables the operator to move away from a particular bolt placement after about ten seconds to a subsequent bore hole. This time savings with secure fixation of the bolt in the bore hole by the use of the substantial exposed channel section is a feature of extreme importance not provided by prior art support plate bolts. With installation completed in ten seconds or less, the present bolt uses a unidirectional spin cycle while providing better anchorage for the bolt.

The present invention thus provides an improved mine roof support plate bolt that is securable in a bore hole rapidly to minimize application time while still providing a firm securement of the bolt.

What is claimed is:

1. In a mine roof support plate bolt formed from a metallic elongated rod, having a head and flange at one end thereof and a channeled section having a helical channel in said rod adjacent the other end, for securement by resin in a bore hole having a closed end, the improvement comprising:

a threaded section on said rod adjacent the channeled section thereof; and an expansion anchor threadedly engaged on the threaded section comprising a wedge and hollow shell; with the channeled section of said rod being of such a length greater than the length of said anchor such that a major portion of said channeled section is exposed regardless of the positioning of said expansion anchor on said threaded section;

whereby the expansion anchor provides initial securement in the bore hole while the resin is mixed and pumped towards the closed end of the bore hole by said helical channel and then sets up to secure the support plate bolt in said bore hole.

2. In a mine roof support plate bolt as defined in claim 2, the improvement wherein said channeled section has a helical, counterclockwise channel and said threaded section has right handed threads.

3. In a mine roof support plate bolt as defined in claim 1, the improvement wherein said channeled section has a helical, clockwise channel and said threaded section has left handed threads.

4. In a mine roof support plate bolt as defined in claim 1, the improvement wherein a transverse groove is provided in said other end forming cutting teeth.

5. In a mine roof support plate bolt as defined in claim 4, the improvement wherein said channel communicates with said transverse groove.

6. In a mine roof support plate bolt as defined in claim 1, the improvement wherein said threaded section on said rod has a length longer than the length of said channeled section.

7. In a mine roof support plate bolt as defined in claim 1, the improvement wherein said other end has an enlarged cutting head thereon in the form of a truncated cone, the truncated cone having an apex, and a base having a diameter greater than the diameter of the channeled section of said rod.

8. In a mine roof support plate bolt as defined in claim 7, the improvement wherein a transverse groove is formed in the apex of said enlarged cutting head.

9. In a mine roof support plate bolt as defined in claim 1, the improvement wherein said other end is substantially flat.

10. In a mine roof support plate bolt as defined in claim 9, the improvement wherein a transverse groove is formed in said flat end to form extensions which comprise cutting teeth.

11. In a mine roof support plate bolt as defined in claim 1, the improvement wherein said elongated rod is formed from first and second segments engageable to form said elongated rod.

12. In a mine roof support plate bolt as defined in claim 11, the improvement wherein said first segment of said rod has said channeled section thereon, said second segment of said rod has said threaded section thereon, and said first and second segments are threadedly engaged to form said elongated rod.

13. In a mine roof support plate bolt as defined in claim 12, the improvement wherein said second segment has a threaded end which engages with a threaded bore in the end of said first segment.

14. In a mine roof support plate bolt formed from a metallic elongated rod, having a head and flange at one end thereof and a transverse groove in the other end forming cutting teeth, with a channeled section having a helical channel in said rod adjacent said other end, for securement by resin in a bore hole having a closed end, the improvement comprising:

a threaded section on said rod adjacent the channeled section thereof, which threaded section has a length longer than the length of said channeled section; and an expansion anchor threadedly engaged on the threaded section comprising a wedge and hollow shell; with at least a portion of said wedge always being within said shell when engaged on said threaded portion; with the channeled section of said rod being of such a length greater than the length of said anchor such that a major portion of said channeled section is exposed regardless of the positioning of said expansion anchor on said threaded section;

whereby the expansion anchor provides initial securement in the bore hole while the resin is mixed and pumped towards the closed end of the bore hole by said helical channel and then sets up to secure the support plate bolt in said bore hole.

* * * * *